US010504408B2

(12) United States Patent
Han et al.

(10) Patent No.: US 10,504,408 B2
(45) Date of Patent: Dec. 10, 2019

(54) PARTITION-BASED GATE DRIVING METHOD AND APPARATUS AND GATE DRIVING UNIT

(71) Applicant: BOE Technology Group Co., Ltd., Beijing (CN)

(72) Inventors: Mingfu Han, Beijing (CN); Guangliang Shang, Beijing (CN); Han-Seung- Woo, Beijing (CN); Xing Yao, Beijing (CN); Zhihe Jin, Beijing (CN); Haoliang Zheng, Beijing (CN); Lijun Yuan, Beijing (CN); Zhichong Wang, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 15/682,740

(22) Filed: Aug. 22, 2017

(65) Prior Publication Data

US 2018/0197455 A1 Jul. 12, 2018

(30) Foreign Application Priority Data

Jan. 12, 2017 (CN) ..... 2017 1 0020679

(51) Int. Cl.
*G09G 3/20* (2006.01)
*G09G 3/36* (2006.01)

(52) U.S. Cl.
CPC ..... *G09G 3/2085* (2013.01); *G09G 3/3677* (2013.01); *G09G 2300/0408* (2013.01);
(Continued)

(58) Field of Classification Search
CPC ..... G09G 3/2085; G09G 2310/04; G09G 2310/08; G09G 2330/021
See application file for complete search history.

(56) References Cited

U.S. PATENT DOCUMENTS 8,514,163 B2 8/2013 Pak et al.
9,423,994 B2 * 8/2016 Suresh ..... G09G 5/14
(Continued)

FOREIGN PATENT DOCUMENTS

CN 102903322 A 1/2013
CN 104137050 A 11/2014
(Continued)

OTHER PUBLICATIONS

First Office Action, including Search Report, for Chinese Patent Application No. 201710020679.4, dated Aug. 1, 2018, 24 pages.

*Primary Examiner* — Ariel A Balaoing
(74) *Attorney, Agent, or Firm* — Westman, Champlin & Koehler, P.A.

(57) ABSTRACT

The embodiments of the present disclosure provide a partition-based gate driving method and apparatus and a gate driving unit, and relates to the field of display technology. In the embodiments of the present disclosure, the partition-based gate driving method comprises: generating a control signal according to an acquired human eye observation partition; generating a second clock signal or a third clock signal according to the control signal; and controlling a second output signal according to the second clock signal or controlling a third output signal according to the third clock signal, thereby controlling the display area to be displayed by partitions.

15 Claims, 7 Drawing Sheets

(52) U.S. Cl.
CPC . *G09G 2310/0286* (2013.01); *G09G 2310/04* (2013.01); *G09G 2310/08* (2013.01); *G09G 2330/021* (2013.01)

(56) References Cited

U.S. PATENT DOCUMENTS

| | | | | |
|---|---|---|---|---|
| 9,972,265 | B2 * | 5/2018 | Na | G09G 3/3666 |
| 2007/0040792 | A1 * | 2/2007 | Kwag | G09G 3/2092 345/100 |
| 2007/0273682 | A1 * | 11/2007 | Yi | G09G 3/3611 345/211 |
| 2008/0111833 | A1 * | 5/2008 | Thorn | G09G 5/00 345/690 |
| 2009/0303211 | A1 * | 12/2009 | Hu | G11C 19/28 345/204 |
| 2011/0169793 | A1 * | 7/2011 | Chen | G09G 3/3677 345/205 |
| 2014/0049512 | A1 * | 2/2014 | Yang | G06F 3/0412 345/174 |
| 2014/0119490 | A1 * | 5/2014 | Yang | G09G 3/3677 377/64 |
| 2015/0154902 | A1 * | 6/2015 | Lee | G09G 3/20 345/213 |
| 2016/0343331 | A1 * | 11/2016 | Dai | G09G 3/3677 |
| 2017/0160799 | A1 * | 6/2017 | Shi | G06F 3/013 |

FOREIGN PATENT DOCUMENTS

| | | | |
|---|---|---|---|
| CN | 104834446 | A | 8/2015 |
| CN | 106205449 | A | 12/2016 |

* cited by examiner

PARTITION-BASED GATE DRIVING METHOD AND APPARATUS AND GATE DRIVING UNIT

CROSS-REFERENCE TO RELATED APPLICATION(S)

This application claims priority to the Chinese Patent Application No. 201710020679.4, filed on Jan. 12, 2017, entitled "GOA PARTITION-BASED GATE DRIVING METHOD AND APPARATUS AND GOA UNIT," which is incorporated herein by reference in its entirety.

TECHNICAL FIELD

The present disclosure relates to the field of display technology, and more particularly, to a partition-based gate driving method and apparatus and a gate driving unit.

BACKGROUND

With the progress of science and technology, in recent years, the development in the field of display technology shows a trend to a high degree of integration and a low cost, and most display apparatuses, such as Thin Film Transistor Liquid Crystal Displays (TFT LCDs) use the Gate Driver on Array (GOA) technology, which refers to a technology for arranging a GOA circuit for driving gate lines on two sides of an active display area of an array substrate of a display apparatus.

Currently, a conventional GOA circuit comprises a plurality of GOA units. A conventional GOA unit can only provide a switching signal to an entire row of gate lines in an array of pixels, to control ON and OFF states of the entire row of gate lines, thereby displaying each frame of image.

SUMMARY

When the related technology is applied, it is found that the related technology in which a conventional GOA unit controls ON and OFF states of an entire row of gate lines thereby displaying each frame of image may cause extra power loss of a GOA circuit and a data Integrated Circuit (IC) circuit.

In order to at least partially solve or alleviate the above problems, a partition-based gate driving method, a corresponding partition-based gate driving apparatus, and a GOA unit according to the embodiments of the present disclosure are proposed.

According to an aspect of the present disclosure, there is provided a partition-based gate driving method, comprising:

generating a control signal according to an acquired human eye observation partition;

generating a second clock signal or a third clock signal according to the control signal; and controlling a second output signal according to the second clock signal or controlling a third output signal according to the third clock signal, thereby controlling refresh rates of a corresponding human eye observation partition and a corresponding non-human eye observation partition in a display area, respectively.

In some embodiments, controlling a second output signal according to the second clock signal or controlling a third output signal according to the third clock signal, thereby controlling refresh rates of a corresponding human eye observation partition and a corresponding non-human eye observation partition in a display area respectively comprises:

controlling partitions in the display area corresponding to the second output signal or the third output signal to be refreshed when the second output signal or the third output signal is output at a high level, and controlling partitions in the display area corresponding to the second output signal or the third output signal not to be refreshed when the second output signal or the third output signal is output at a low level.

According to an aspect of the present disclosure, there is provided a partition-based gate driving apparatus, comprising:

a control signal generation module configured to generate a control signal according to an acquired human eye observation partition;

a clock signal generation module configured to generate a second clock signal or a third clock signal according to the control signal; and a partition display control module configured to control a second output signal according to the second clock signal or control a third output signal according to the third clock signal, thereby controlling refresh rates of a corresponding human eye observation partition and a corresponding non-human eye observation partition in a display area, respectively.

In some embodiments, the partition display control module comprises:

a display area control module configured to control partitions in the display area corresponding to the second output signal or the third output signal to be refreshed when the second output signal or the third output signal is output at a high level and configured to control partitions in the display area corresponding to the second output signal or the third output signal not to be refreshed when the second output signal or the third output signal is output at a low level.

According to an aspect of the present disclosure, there is provided a gate driving unit, comprising a shift unit and a partition unit, wherein the shift unit is configured to control a first output signal of the shift unit under the control of a shift pulse input from a first input signal terminal; and the partition unit is configured to receive the first output signal from the shift unit as a second input signal of the partition unit, and the partition unit further configured to control a second output signal of the partition unit under the control of a second clock signal or control a third output signal of the partition unit under the control of a third clock signal, thereby controlling refresh rates of a corresponding human eye observation partition and a corresponding non-human eye observation partition in a display area, respectively.

In some embodiments, the partition unit comprises a second input module, a second pull-up node reset module, a second reset module, a second output module, a third output module, a second de-noising module and a third de-noising module, wherein, the second input module is connected to a first output signal terminal of the shift unit and a second pull-up node respectively, and is configured to pull up a potential at the second pull-up node under the control of a first output signal from the first output signal terminal;

the second pull-up node reset module is connected to the second pull-up node and a second pull-down signal terminal respectively, and is configured to control the potential at the second pull-up node under the control of a second pull-down signal provided by the second pull-down signal terminal;

the second reset module is connected to a second reset signal terminal and the second pull-up node respectively, and is configured to reset the potential at the second pull-up node under the control of a second reset signal provided by the second reset signal terminal;

the second output module is connected to the second pull-up node, a second clock signal terminal and a second output signal terminal respectively, and is configured to control a second output signal at the second output signal terminal under the control of the second pull-up node and a second clock signal;

the third output module is connected to the second pull-up node, a third clock signal terminal and a third output signal terminal respectively, and is configured to control a third output signal at the third output signal terminal under the control of the second pull-up node and a third clock signal;

the second de-noising module is connected to the second output signal terminal and the second pull-down signal terminal respectively, and is configured to de-noise the second output signal at the second output signal terminal under the control of the second pull-down signal provided by the second pull-down signal terminal; and the third de-noising module is connected to the third output signal terminal and the second pull-down signal terminal respectively, and is configured to de-noise the third output signal at the third output signal terminal under the control of the second pull-down signal provided by the second pull-down signal terminal.

In some embodiments, the second input module comprises a ninth transistor having a control terminal connected to the first output signal terminal, an input terminal connected to a power supply terminal and an output terminal connected to the second pull-up node.

In some embodiments, the second pull-up node reset module comprises an eleventh transistor having a control terminal connected to the second pull-down signal terminal, an input terminal connected to the second pull-up node and an output terminal connected to a low level terminal.

In some embodiments, the second reset module comprises a tenth transistor having a control terminal connected to the second reset signal terminal, an input terminal connected to the second pull-up node and an output terminal connected to a low level terminal.

In some embodiments, the second output module comprises a fifth transistor having a control terminal connected to the second pull-up node, an input terminal connected to the second clock signal terminal and an output terminal connected to the second output signal terminal.

In some embodiments, the third output module comprises a seventh transistor having a control terminal connected to the second pull-up node, an input terminal connected to the third clock signal terminal and an output terminal connected to the third output signal terminal.

In some embodiments, the second de-noising module comprises a sixth transistor having a control terminal connected to the second pull-down signal terminal, an input terminal connected to the second output signal terminal and an output terminal connected to a low level terminal.

In some embodiments, the third de-noising module comprises an eighth transistor having a control terminal connected to the second pull-down signal terminal, an input terminal connected to the third output signal terminal and an output terminal connected to a low level terminal.

According to an aspect of the present disclosure, there is provided a gate driving circuit comprising a plurality of cascaded gate driving units, wherein, a first input signal terminal of a first stage of gate driving unit is connected to an initial signal input terminal;

a first output signal terminal of an $N^{th}$ stage of gate driving unit is connected to a first reset signal terminal of an $(N-1)^{th}$ stage of gate driving unit, where N is an integer greater than or equal to 3;

the first output signal terminal of the $N^{th}$ stage of gate driving unit is connected to a second reset signal terminal of an $(N-2)^{th}$ stage of gate driving unit;

the first output signal terminal of the $N^{th}$ stage of gate driving unit is connected to a first input signal terminal of an $(N+1)^{th}$ stage of gate driving unit; and a first pull-down signal terminal of the $N^{th}$ stage of gate driving unit is connected to a second pull-down signal terminal of the $(N-1)^{th}$ stage of gate driving unit.

According to another aspect of the present disclosure, there is provided a display apparatus comprising the gate driving circuit.

BRIEF DESCRIPTION OF THE DRAWINGS

Various other advantages and benefits will become apparent to those of ordinary skill in the art upon reading the following detailed description of specific embodiments. The accompanying drawings are only for the purpose of illustrating a part of the embodiments and are not intended to be construed as limiting the present disclosure. Throughout the accompanying drawings, the same reference numerals are used to designate the same parts. In the accompanying drawings.

DETAILED DESCRIPTION

Exemplary embodiments of the present disclosure will be described in more detail below with reference to the accompanying drawings. Although the exemplary embodiments of the present disclosure are shown in the accompanying drawings, it should be understood that the present disclosure can be embodied in various forms and should not be limited to the embodiments set forth herein. Rather, these embodiments are provided to enable a more thorough understanding of the present disclosure and to completely convey the scope of the present disclosure to those skilled in the art.

Figure 1:
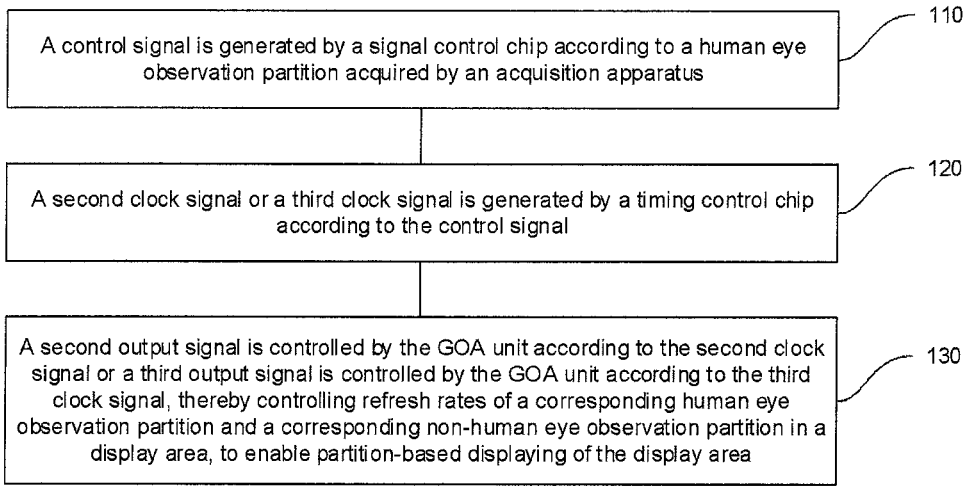
FIG. 1 illustrates a flowchart of steps of an exemplary GOA partition-based driving method according to an embodiment of the present disclosure.

As shown in FIG. 1, illustrated is a flowchart of steps of an embodiment of an exemplary GOA partitioned-based driving method according to an embodiment of the present disclosure. The method may specifically comprise the following steps.

In step 110, a control signal is generated by a signal control chip according to a human eye observation partition acquired by an acquisition apparatus.

In some embodiments, the human eye observation partition may be acquired by the acquisition apparatus, which may comprise a camera that transmits the human eye observation partition acquired by the acquisition apparatus to the signal control chip via a serial port. The signal control chip may comprise a single chip and may perform algorithm processing according to the human eye observation partition to generate the control signal. However, the present disclosure is not limited to the manner described above. For example, the acquisition apparatus may further comprise other means than the camera for determining the human eye observation partition, such as special contact lenses worn on human eyes. In addition, the acquired human eye observation partition may also be transmitted to the signal control chip via other interfaces, such as Wi-Fi, Bluetooth, USB, $I^2C$ bus, or any other suitable wired or wireless communication interface etc.

In step 120, a second clock signal or a third clock signal is generated by a timing control chip according to the control signal.

After the signal control chip performs algorithm processing according to the human eye observation partition to generate the control signal, the signal control chip feeds back the control signal into a Timer Control Register (TCON), which is a timing control chip, and the timing control chip generates the second clock signal or the third clock signal according to the control signal and outputs the second clock signal or the third clock signal to GOA units.

Figure 1A:
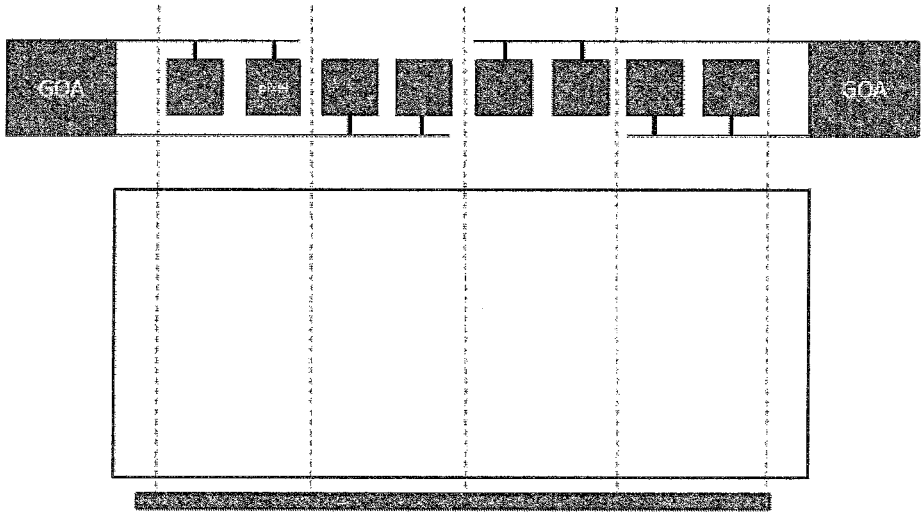
FIG. 1A illustrates an exemplary structural diagram of partitioning of a display area according to an embodiment of the present disclosure.

As shown in FIG. 1A, illustrated is an exemplary structural diagram of partitioning of a display area according to an embodiment of the present disclosure.

For example, the display area has two unilateral GOA units, wherein each GOA unit controls two independent second output signals or third output signals according to the second clock signal or the third clock signal, and provides switching signals to gate lines of a pixel array according to the second output signals or the third output signals. The display area is equally divided into four partitions in a longitudinal direction, wherein each partition has output signals controlled by a GOA unit.

At the same time, in order to improve the capability of partitioning of the display area, a plurality of GOA units may be used and the display area is divided into more partitions according to output signals controlled by the plurality of GOA units.

Figure 1B:
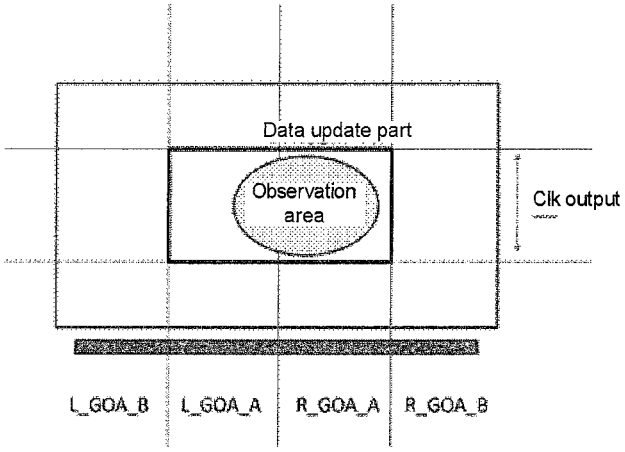
FIG. 1B illustrates an exemplary structural diagram of an observation partition in a display area according to an embodiment of the present disclosure.

As shown in FIG. 1B, illustrated is an exemplary structural diagram of an observation partition in a display area according to an embodiment of the present disclosure.

When the display area is equally divided by two unilateral GOA units into four parts in a longitudinal direction, partitions controlled by a left GOA unit are L_GOA_B and L_GOA_A, respectively, and partitions controlled by a right GOA unit are R_GOA_B and R_GOA_A, respectively. In the display area, if the observation partition is located in the L_GOA_A partition and the R_GOA_A partition of the display area, the observation partition is a Data update part, and a clock signal CLK is output by a timing control chip in the observation partition.

Figure 1C:
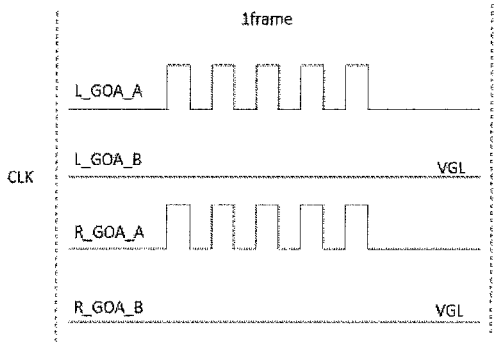
FIG. 1C illustrates an exemplary diagram of a clock signal corresponding to the observation partition in FIG. 1B.

As shown in FIG. 1C, illustrated is an exemplary diagram of a clock signal corresponding to the observation partition in FIG. 1B.

In the display area, if the observation partition is located in the L_GOA_A partition and R_GOA_A partition of the display area, the clock signal CLK is output by the timing control chip in the L_GOA_A partition and the R_GOA_A partition, and no clock signal is output by the timing control chip in the L_GOA_B partition and the R_GOA_B partition.

Figure 1D:
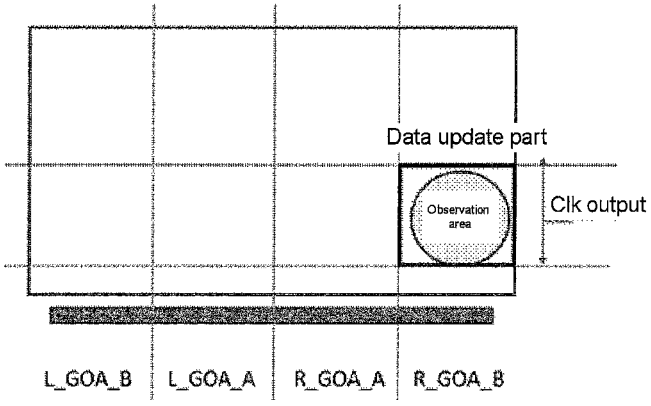
FIG. 1D illustrates another exemplary structural diagram of an observation partition in a display area according to an embodiment of the present disclosure.

As shown in FIG. 1D, illustrated is another exemplary structural diagram of an observation partition in a display area according to an embodiment of the present disclosure.

When the display area is equally divided by two unilateral GOA units into four parts in a longitudinal direction, partitions controlled by a left GOA unit are L_GOA_B and L_GOA_A, respectively, and partitions controlled by a right GOA unit are R_GOA_B and R_GOA_A, respectively. In the display area, if the observation partition is located in the R_GOA_B partition of the display area, the observation partition is a Data update part, and a clock signal CLK is output by a timing control chip in the observation partition.

Figure 1E:
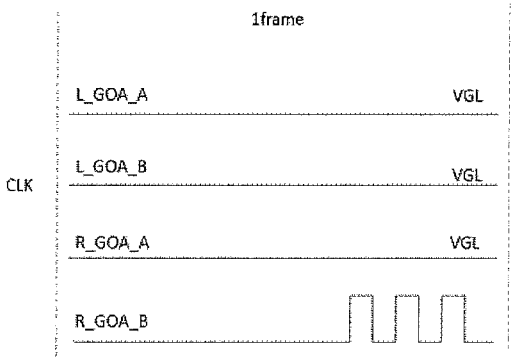
FIG. 1E illustrates an exemplary diagram of a clock signal corresponding to the observation partition in FIG. 1D.

As shown in FIG. 1E, illustrated is an exemplary diagram of a clock signal corresponding to the observation partition in FIG. 1D.

In the display area, if the observation partition is in the R_GOA_B partition of the display area, the clock signal CLK is output by a timing control chip in the R_GOA_B partition, and no clock signal is output by the timing control chip in the L_GOA_B partition, the L_GOA_A partition and the R_GOA_A partition.

Referring back to FIG. 1, in step 130, a second output signal is controlled by the GOA unit according to the second clock signal or a third output signal is controlled by the GOA unit according to the third clock signal, thereby controlling refresh rates of a corresponding human eye observation partition and a corresponding non-human eye observation partition in a display area, to enable partitioned-based displaying of the display area.

The GOA unit controls the second output signal according to the second clock signal generated by the timing control chip or controls the third output signal according to the third clock signal generated by the timing control chip, thereby controlling refresh rates of a corresponding human eye observation partition and a corresponding non-human eye observation partition in a display area according to the second output signal or the third output signal, to enable partition-based displaying of the display area.

The GOA unit may control the corresponding human eye observation partition in the display area to present at a normal refresh rate and may control the corresponding non-human eye observation partition in the display area to decrease the refresh rate.

Alternatively, the GOA unit may also control the corresponding human eye observation partition in the display area to decrease the refresh rate and may control the corresponding non-human eye observation partition in the display area to present at a normal refresh rate.

When the second output signal or the third output signal is output at a high level, partitions in the display area corresponding to the second output signal or the third output signal are controlled to be refreshed; and when the second output signal or the third output signal is output at a low level, partitions in the display area corresponding to the second output signal or the third output signal are controlled not to be refreshed.

Compared with the related art, the embodiments of the present disclosure have at least the following advantages.

According to the GOA partitioned-based method according to the present disclosure, the signal control chip generates a control signal according to a human eye observation partition acquired by the acquisition apparatus, the timing control chip generates a second clock signal or a third clock signal according to the control signal, and the GOA unit controls a second output signal according to the second clock signal or controls a third output signal according to the third clock signal, thereby controlling refresh rates of a corresponding human eye observation partition and a corresponding non-human eye observation partition in the display area, to enable partition-based displaying of the display area. The GOA unit achieves control of a two-dimensional display area according to the second clock signal or the third clock signal, and presents different refresh rates in the human eye observation partition and the non-human eye observation partition, thereby solving the problem that the conventional GOA unit controls ON and OFF states of an entire row of gate lines but cannot realize independent ON state of a partition of the area, which causes extra power loss of a GOA circuit and a data IC circuit. The GOA unit controls partition-based displaying of the display area, which can significantly reduce the power loss of the GOA circuit and the data IC circuit.

For the method embodiment, for the sake of simplicity, it is described as a combination of a series of actions, but those skilled in the art will recognize that the embodiments of the present disclosure are not limited to the order of actions described, as according to the embodiments of the present disclosure, some steps can be performed in another order or at the same time. Secondly, it will be understood by those skilled in the art that the embodiments described in the specification are specific embodiments and the actions involved are not necessary for the embodiments of the present disclosure.

Figure 2:
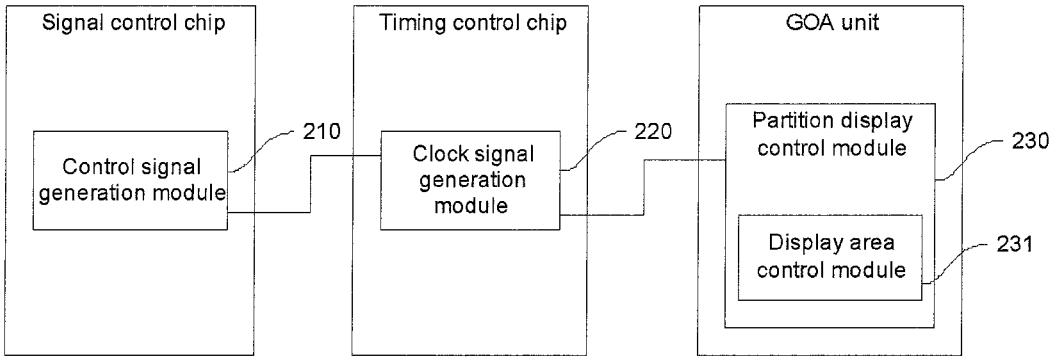
FIG. 2 illustrates a structural block diagram of a GOA partition-based driving apparatus according to another embodiment of the present disclosure.

As shown in FIG. 2, there is illustrated an exemplary structural block diagram of an embodiment of a GOA partitioned-based driving apparatus according to an embodiment of the present disclosure. The apparatus may specifically comprise the following modules:

a control signal generation module 210 configured to generate, by a signal control chip, a control signal according to a human eye observation partition acquired by an acquisition apparatus;

a clock signal generation module 220 configured to generate, by a timing control chip, a second clock signal or a third clock signal according to the control signal; and a partition display control module 230 configured to control, by a GOA unit, a second output signal according to the second clock signal or a third output signal according to the third clock signal, thereby controlling refresh rates of a corresponding human eye observation partition and a corresponding non-human eye observation partition in a display area, to enable partition-based displaying of the display area.

In some embodiments, the partition display control module 230 comprises:

a display area control module 231 configured to control partitions in the display area corresponding to the second output signal or the third output signal to be refreshed when the second output signal or the third output signal is output at a high level, and control partitions in the display area corresponding to the second output signal or the third output signal not to be refreshed when the second output signal or the third output signal is output at a low level.

Compared with the related art, the embodiments of the present disclosure have at least the following advantages.

According to the GOA partitioned-based driving apparatus according to the present disclosure, the signal control chip generates a control signal according to a human eye observation partition acquired by the acquisition apparatus, the timing control chip generates a second clock signal or a third clock signal according to the control signal, and the GOA unit controls a second output signal according to the second clock signal or controls a third output signal according to the third clock signal, thereby controlling refresh rates of a corresponding human eye observation partition and a corresponding non-human eye observation partition in the display area, to enable partition-based displaying of the display area. The GOA unit achieves control of a two-dimensional display area according to the second clock signal or the third clock signal, and presents different refresh rates in the human eye observation partition and the non-human eye observation partition, thereby solving the problem that the conventional GOA unit controls ON and OFF states of an entire row of gate lines but cannot realize independent ON state of a partition of the area, which causes extra power loss of a GOA circuit and a data IC circuit. The GOA unit controls partition-based displaying of the display area, which can significantly reduce the power loss of the GOA circuit and the data IC circuit.

In addition, in some embodiments, the GOA partitioned-based driving apparatus may comprise the acquisition apparatus, the signal control chip, the timing control chip, and the GOA unit.

The signal control chip generates a control signal based on a human eye observation partition acquired by the acquisition apparatus; the timing control chip generates a second clock signal or a third clock signal according to the control signal; and the GOA unit comprises a shift unit and a partition unit.

The shift unit is configured to control a first output signal thereof under the control of a shift pulse input from a first input signal terminal.

The partition unit is configured to perform a GOA partition-based driving, wherein a second input signal of the partition unit is a first output signal of the shift unit, configured to control a second output signal thereof under the control of the second clock signal generated by the timing control chip or control a third output signal thereof under the control of the third clock signal generated by the timing control chip, thereby controlling refresh rates of a corresponding human eye observation partition and a corresponding non-human eye observation partition in a display area, to realize partition-based displaying of the display area.

When the second output signal or the third output signal is output at a high level, partitions in the display area corresponding to the second output signal or the third output signal are controlled to be refreshed; and when the second output signal or the third output signal is output at a low level, partitions in the display area corresponding to the second output signal or the third output signal are controlled not to be refreshed.

Figure 3:
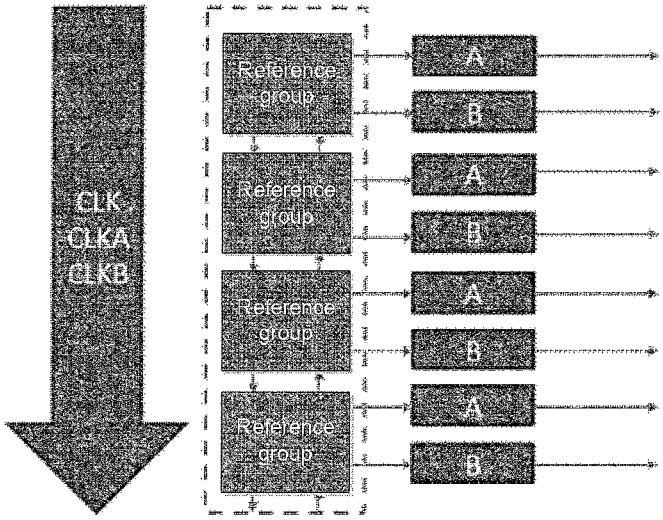
FIG. 3 illustrates a structural diagram of an exemplary GOA unit according to another embodiment of the present disclosure.

As shown in FIG. 3, illustrated is an exemplary structural diagram of a GOA unit according to an embodiment of the present disclosure.

The GOA unit comprises a reference group, a second output signal terminal A controlled by a second clock signal CLKA and a third output signal terminal B controlled by a third clock signal CLKB, wherein the reference group comprises a shift unit in the GOA unit, which controls a first output signal thereof under the control of a shift pulse CLK input at a first input signal terminal.

Compared with the related art, the embodiments of the present disclosure have at least the following advantages.

The GOA unit according to the present disclosure controls a second output signal according to a second clock signal or controls a third output signal according to a third clock signal, thereby controlling refresh rates of a corresponding human eye observation partition and a corresponding non-human eye observation partition in a display area, to enable partition-based displaying of the display area. The GOA unit realizes control of a two-dimensional display area according to the second clock signal or the third clock signal, and presents different refresh rates in the human eye observation partition and the non-human eye observation partition, thereby solving the problem that the conventional GOA unit control ON and OFF states of an entire row of gate lines but cannot realize independent ON state of a partition of the area, which causes extra power loss of a GOA circuit and a data IC circuit. The GOA unit controls partition-based displaying of the display area, which can significantly reduce the power loss of the GOA circuit and the data IC circuit.

Figure 4:
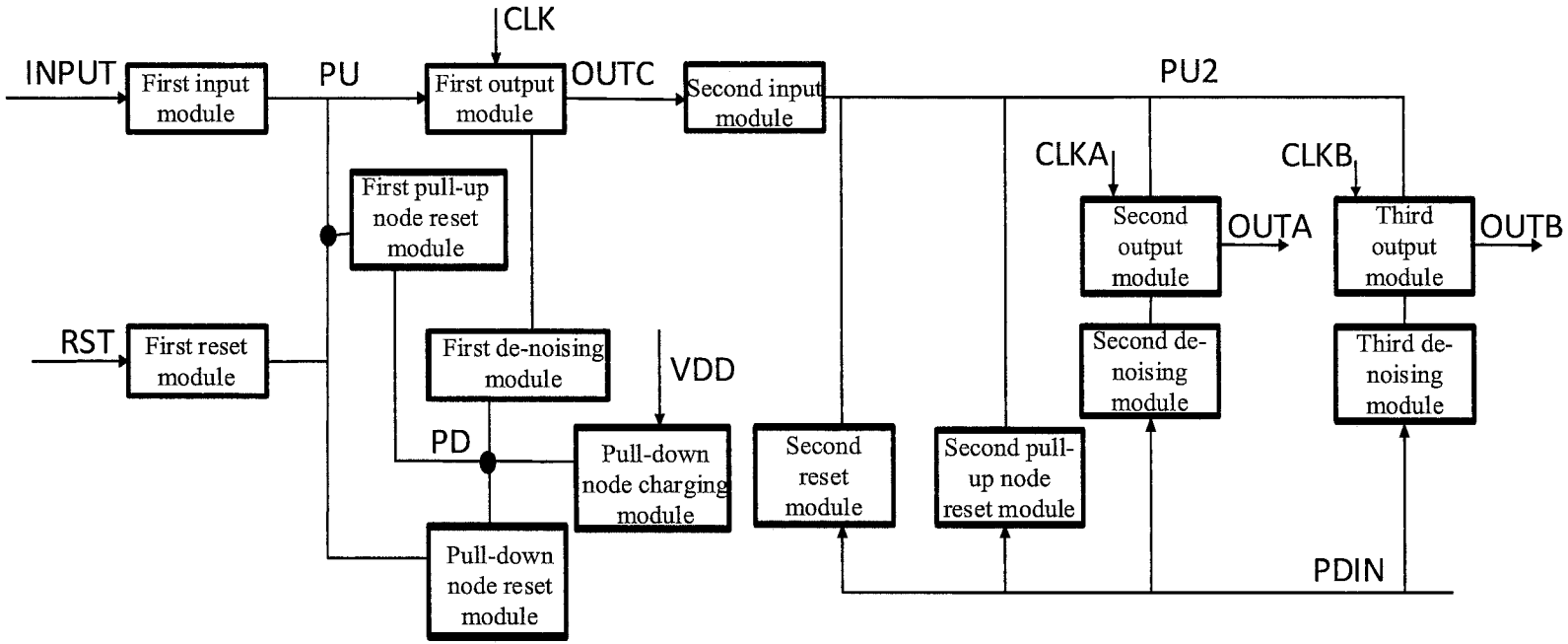
FIG. 4 illustrates a basic structural diagram of an exemplary GOA unit circuit according to another embodiment of the present disclosure.

As shown in FIG. 4, illustrated is a basic structural diagram of a GOA unit circuit according to the present disclosure.

The GOA unit comprises a shift unit and a partition unit. The shift unit comprises a first input module, a first pull-up node reset module, a pull-down node reset module, a first reset module, a first output module, a first de-noising module and a pull-down node charging module, and is configured to realize a function of shift registering. The partition unit comprises a second input module, a second pull-up node reset module, a second reset module, a second output module, a third output module, a second de-noising module and a third de-noising module, and is configured to realize a function of partition-based displaying.

The first input module is connected to a first input signal terminal INPUT and a first pull-up node PU respectively, and is configured to pull up a potential at the first pull-up node PU under the control of a shift pulse input at the first input signal terminal INPUT.

The first pull-up node reset module is connected to the first pull-up node PU and a first pull-down signal terminal PD respectively, and is configured to control the potential at the first pull-up node PU under the control of a first pull-down signal provided by the first pull-down signal terminal PD.

The pull-down node reset module is connected to the first pull-up node PU and the first pull-down signal terminal PD respectively, and is configured to control a potential at the first pull-down signal terminal PD under the control of the first pull-up node PU.

The first reset module is connected to a first reset signal terminal RST and the first pull-up node PU respectively, and is configured to reset the potential at the pull-up node PU under the control of a first reset signal provided by the first reset signal terminal RST.

The first output module is connected to the first pull-up node PU, a first clock signal terminal CLK and a first output signal terminal OUTC respectively, and is configured to control a first output signal at the first output signal terminal OUTC under the control of the first pull-up node PU and a first clock signal.

The first de-noising module is connected to the first output signal terminal OUTC and the first pull-down signal terminal PD respectively, and is configured to de-noise the first output signal at the first output signal terminal OUTC under the control of the first pull-down signal provided by the first pull-down signal terminal PD.

The pull-down node charging module is connected to the first pull-down node PD and a power supply terminal VDD respectively, and is configured to charge the first pull-down node PD under the control of the power supply terminal VDD.

The second input module is connected to the first output signal terminal OUTC of the shift unit and a second pull-up node PU2 respectively, and is configured to pull up a potential at the second pull-up node PU2 under the control of the first output signal at the first output signal terminal OUTC.

The second pull-up node reset module is connected to the second pull-up node PU2 and a second pull-down signal terminal PDIN respectively, and is configured to control the potential at the second pull-up node PU2 under the control of a second pull-down signal provided by the second pull-down signal terminal PDIN.

Figure 4A:
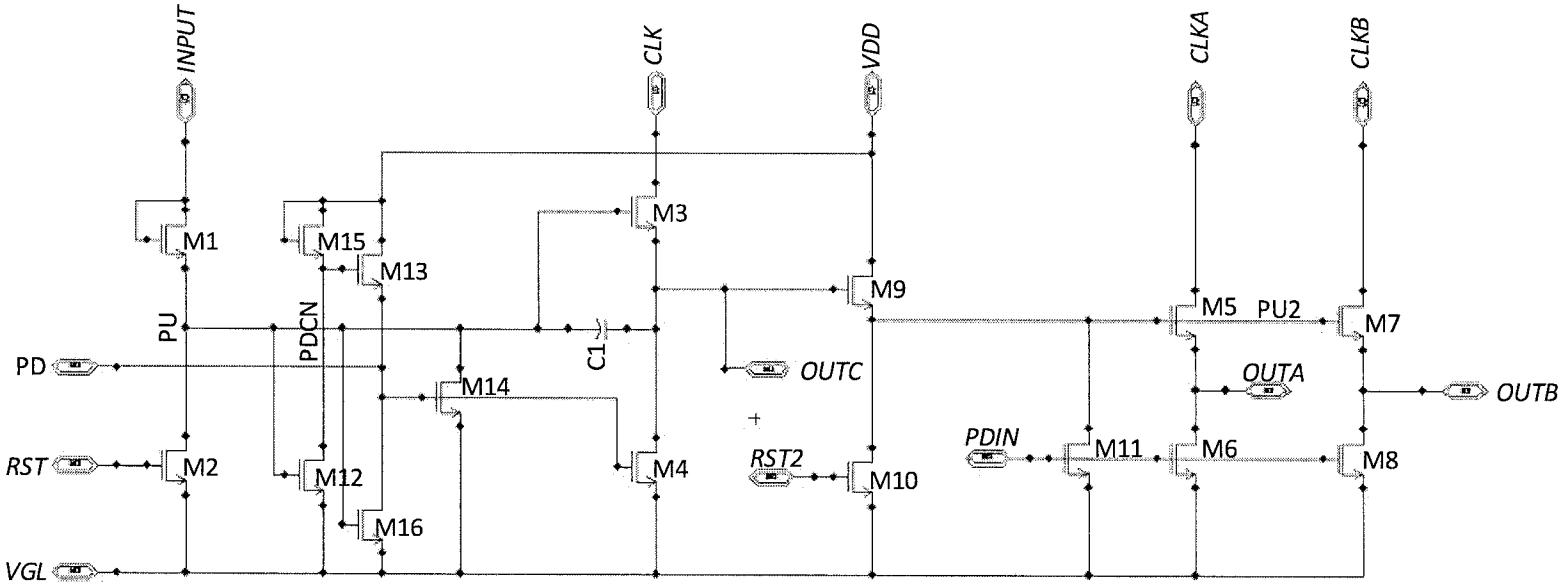
FIG. 4A illustrates a specific structural diagram of the exemplary GOA unit circuit shown in FIG. 4.

The second reset module is connected to a second reset signal terminal RST2 (as shown in FIG. 4A for example) and the second pull-up node PU2 respectively, and is configured to reset the potential at the second pull-up node PU2 under the control of a second reset signal provided by the second reset signal terminal RST2.

The second output module is connected to the second pull-up node PU2, a second clock signal terminal CLKA and a second output signal terminal OUTA respectively, and is configured to control a second output signal at the second output signal terminal OUTA under the control of the second pull-up node PU2 and a second clock signal.

The third output module is connected to the second pull-up node PU2, a third clock signal terminal CLB and a third output signal terminal OUTB respectively, and is configured to control a third output signal at the third output signal terminal OUTB under the control of the second pull-up node PU2 and a third clock signal.

The second de-noising module is connected to the second output signal terminal OUTA and the second pull-down signal terminal PDIN respectively, and is configured to de-noise the second output signal at the second output signal terminal OUTA under the control of the second pull-down signal provided by the second pull-down signal terminal PDIN.

The third de-noising module is connected to the third output signal terminal OUTB and the second pull-down signal terminal PDIN respectively, and is configured to de-noise the third output signal at the third output signal terminal OUTB under the control of the second pull-down signal provided by the second pull-down signal terminal PDIN.

As shown in FIG. 4A, illustrated is a specific structural diagram of the GOA unit circuit shown in FIG. 4.

The first input module comprises a first transistor M1, the first pull-up node reset module comprises a fourteenth transistor M14, the pull-down node reset module comprises a twelfth transistor M12 and a sixteenth transistor M16, the first reset module comprises a second transistor M2, the first output module comprising a third transistor M3, the first de-noising module comprises a fourth transistor M4, and the pull-down node charging module comprises a fifteenth transistor M15 and a thirteenth transistor M13.

The second input module comprises a ninth transistor M9 having a control terminal connected to the first output signal terminal OUTC, an input terminal connected to the power supply terminal VDD and an output terminal connected to the second pull-up node PU2; the second pull-up node reset module comprises an eleventh transistor M11 having a control terminal connected to the second pull-down signal terminal PDIN, an input terminal connected to the second pull-up node PU2 and an output terminal connected to a low level terminal VGL; the second reset module comprises a tenth transistor M10 having a control terminal connected to the second reset signal terminal RST2, an input terminal connected to the second pull-up node PU2 and an output terminal connected to the low level terminal VGL; the second output module comprises a fifth transistor M5 having a control terminal connected to the second pull-up node PU2, an input terminal connected to the second clock signal terminal CLKA and an output terminal connected to the second output signal terminal OUTA; the third output module comprises a seventh transistor M7 having a control terminal connected to the second pull-up node PU2, an input terminal connected to the third clock signal terminal CLKB and an output terminal connected to the third output signal terminal OUTB; the second de-noising module comprises a sixth transistor M6 having a control terminal connected to the second pull-down signal terminal PDIN, an input terminal connected to the second output signal terminal OUTA and an output terminal connected to the low level terminal VGL; and the third de-noising module comprises an eighth transistor M8 having a control terminal connected to the second pull-down signal terminal PDIN, an input terminal connected to the third output signal terminal OUTB and an output terminal connected to the low level terminal VGL.

Figure 4B:
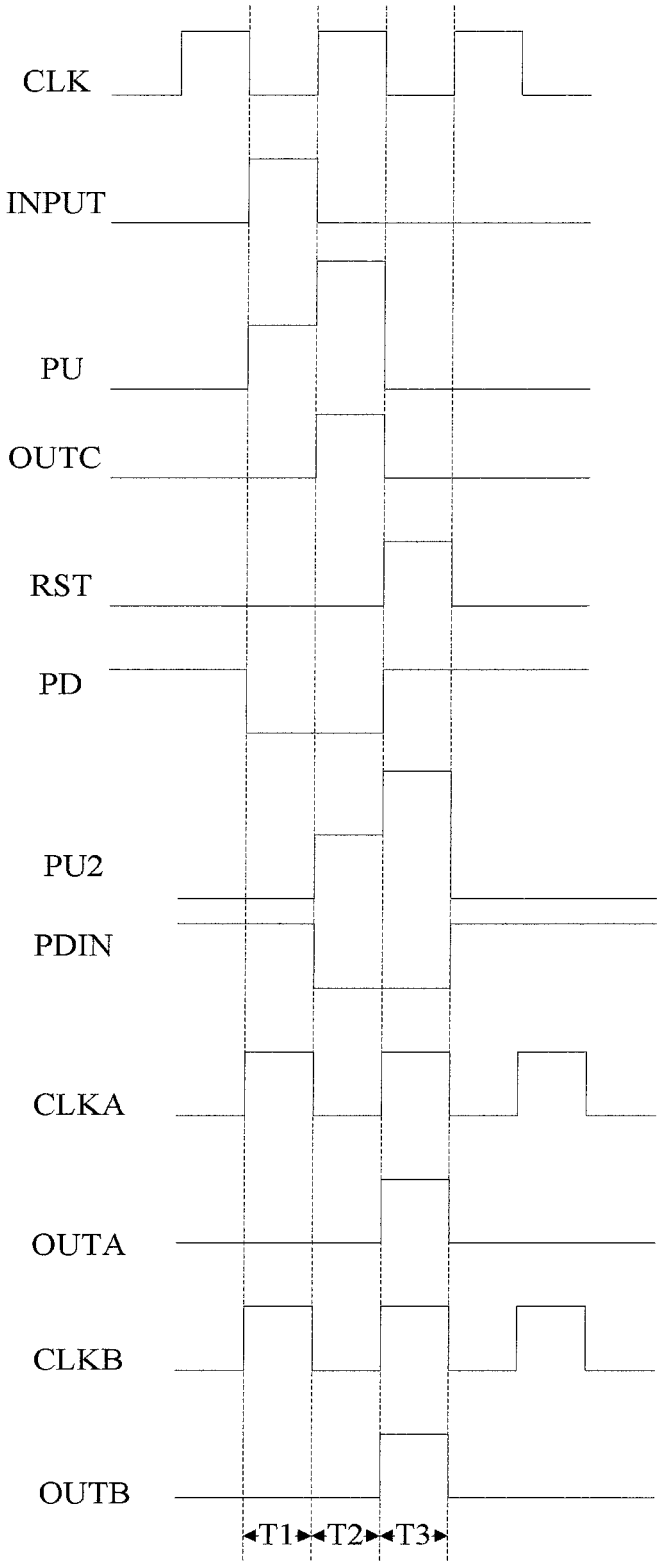
FIG. 4B illustrates a control timing diagram of an exemplary GOA unit circuit according to another embodiment of the present disclosure.

As shown in FIG. 4B, illustrated is an exemplary control timing diagram of a GOA unit circuit.

One ON duration of gate lines comprises three phases, which are a first phase T1, a second phase T2, and a third phase T3. In the first phase T1, the shift pulse input at the first input signal terminal INPUT is at a high level, the first pull-up node PU is pulled up for the first time, the first pull-down node PD is pulled down, and the first output signal OUTC is at a low level. In the second phase T2, the first pull-up node PU continues to be pulled up, the first pull-down node PD is maintained at a low level, when the first clock signal CLK is at a high level, the first output signal OUTC is at a high level, the second input signal is the first output signal OUTC, and under the control of the second input signal, the second pull-up node PU2 is pulled up for the first time, the second pull-down signal PDIN is at a low level, and the second output signal OUTA or the third output signal terminal OUTB is at a low level. In the third phase T3, the first reset signal RST is at a high level, under the control of the first reset signal RST, the first pull-up node PU and the first pull-down node PD are reset, under the control of the second input signal, the second pull-up node PU2 continues to be pulled up, and the second pull-down signal PDIN is maintained at a low level, and when the second clock signal CLKA is at a high level, the second output signal OUTA is at a high level, or when the third clock signal CLKB is at a high level, the third output signal terminal OUTB is at a high level.

The second output signal OUTA is controlled according to the second clock signal CLKA, or the third output signal OUTB is controlled according to the third clock signal CLKB, and turn-on and turn-off of a row of gate lines is controlled according to the second output signal OUTA or the third output signal OUTB. When the second output signal or the third output signal is at a high level, corresponding gate lines are turned on and corresponding partitions in the display area are refreshed, and when the second output signal or the third output signal is at a low level, corresponding gate lines are turned off and corresponding partitions in the display area are not refreshed.

Compared with the related art, the embodiments of the present disclosure have at least the following advantages.

The GOA unit according to the present disclosure controls a second output signal according to a second clock signal or controls a third output signal according to a third clock signal, thereby controlling refresh rates of a corresponding human eye observation partition and a corresponding non-human eye observation partition in a display area, to enable partition-based displaying of the display area. The GOA unit realizes control of a two-dimensional display area according to the second clock signal or the third clock signal, and presents different refresh rates in the human eye observation partition and the non-human eye observation partition, thereby solving the problem that the conventional GOA unit controls ON and OFF states of an entire row of gate lines but cannot realize independent ON state of a partition of the area, which causes extra power loss of a GOA circuit and a data IC circuit. The GOA unit controls partition-based displaying of the display area, which can significantly reduce the power loss of the GOA circuit and the data IC circuit.

Figure 5:
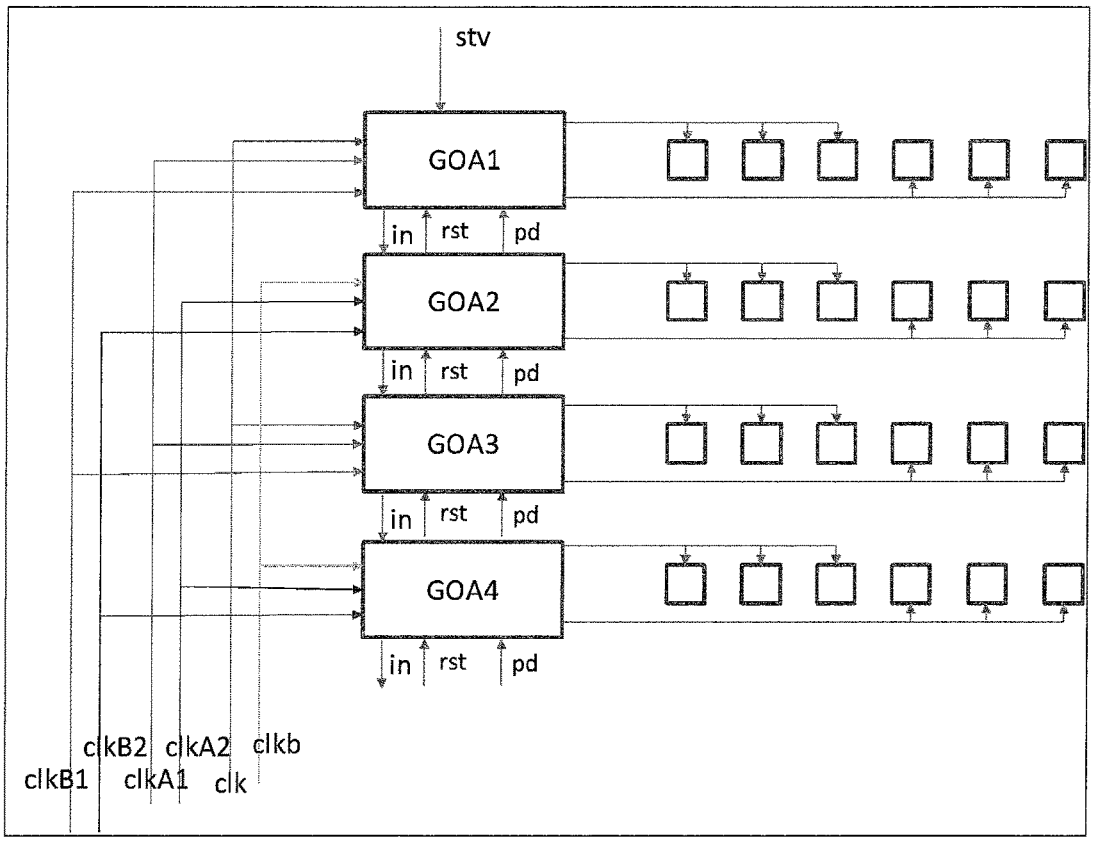
FIG. 5 illustrates a cascaded diagram of various GOA unit circuits in an exemplary GOA circuit according to another embodiment of the present disclosure.

As shown in FIG. 5, illustrated is an exemplary cascaded diagram of various GOA unit circuits in a GOA circuit.

The GOA circuit comprises a plurality of cascaded GOA units. Each GOA unit controls three output signals, which are a first output signal OUTC, a second output signal OUTA, and a third output signal OUTB, respectively. The second output signal OUTA and the third output signal OUTB control pixels of a display area so as to control partition-based displaying, and the first output signal OUTC provides input and reset signals to previous and next stages. The three output signals of each GOA unit which are the first output signal OUTC, the second output signal OUTA, and the third output signal OUTB are controlled by a corresponding first clock signal CLK, a corresponding second clock signal CLKA, and a corresponding third clock signal CLKB, respectively.

A first input signal terminal of a first stage of GOA unit is connected to an initial signal input terminal STV; a first output signal terminal of an $N^{th}$ stage of GOA unit is connected to a first reset signal terminal of an $(N-1)^{th}$ stage of GOA unit, where N is an integer greater than or equal to 3; the first output signal terminal of the $N^{th}$ stage of GOA unit is connected to a second reset signal terminal of an $(N-2)^{th}$ stage of GOA unit; the first output signal terminal of the $N^{th}$ stage of GOA unit is connected to a first input signal terminal of an $(N+1)^{th}$ stage of GOA unit; and a first pull-down signal terminal of the $N^{th}$ stage of GOA unit is connected to a second pull-down signal terminal of the $(N-1)^{th}$ stage of GOA unit.

For example, a first output signal terminal OUTC of a third stage of GOA3 unit is connected to a first reset signal terminal RST of a second stage of GOA2 unit; the first output signal terminal OUTC of the third stage of GOA3 unit is connected to a second reset signal terminal RST2 of a first stage of GOA1 unit; the first output signal terminal OUTC of the third stage of GOA3 unit is connected to a first input signal terminal INPUT of a fourth stage of GOA4 unit; and a first pull-down signal terminal PD of the third stage of GOA3 unit is connected to a second pull-down signal terminal PD2 of the second stage of GOA2 unit.

Each stage of GOA unit controls ON and OFF states of a corresponding row of gate lines according to a corresponding second output signal OUTA or a corresponding third output signal OUTB. When the second output signal or the third output signal is at a high level, gate lines corresponding to the second output signal or the third output signal are turned on, and partitions corresponding to the second output signal or the third output signal in a display area are refreshed, and when the second output signal or the third output signal is at a low level, gate lines corresponding to the second output signal or the third output signal are turned off and partitions corresponding to the second output signal or the third output signal in the display area are not refreshed. A plurality of cascaded GOA units control ON and OFF states of multiple rows of gate lines, thereby controlling partition-based displaying of the entire display area.

The embodiments of the present disclosure further provide a display apparatus comprising the GOA circuit.

Compared with the related art, the embodiments of the present disclosure have at least the following advantages.

The GOA circuit according to the embodiments of the present disclosure comprises a plurality of cascaded GOA units, which control a second output signal according to a second clock signal or control a third output signal according to a third clock signal, thereby controlling refresh rates of a corresponding human eye observation partition and a corresponding non-human eye observation partition in a display area, to enable partition-based displaying of the display area. The GOA units realize control of a two-dimensional display area according to the second clock signal or the third clock signal, and present different refresh rates in the human eye observation partition and the non-human eye observation partition, thereby solving the problem that the conventional GOA units control ON and OFF states of an entire row of gate lines but cannot realize independent ON state of a partition of the area, which causes extra power loss of a GOA circuit and a data IC circuit. The GOA units control partitioning of the display area for display, which can significantly reduce the power loss of the GOA circuit and the data IC circuit.

As the apparatus embodiment is substantially similar to the method embodiment, the description thereof is relatively simple and the relevant part can be known with reference to the description of the part of the method embodiment.

According to the GOA partition-based method and apparatus and the GOA unit according to the present disclosure, the signal control chip generates a control signal according to a human eye observation partition acquired by the acquisition apparatus, the timing control chip generates a second clock signal or a third clock signal according to the control signal, and the GOA unit controls a second output signal according to the second clock signal or controls a third output signal according to the third clock signal, thereby controlling refresh rates of a corresponding human eye observation partition and a corresponding non-human eye observation partition in the display area, to enable partition-based displaying of the display area. The GOA unit realizes control of a two-dimensional display area according to the second clock signal or the third clock signal, and presents different refresh rates in the human eye observation partition and the non-human eye observation partition, thereby solving the problem that the conventional GOA unit controls ON and OFF states of an entire row of gate lines but cannot realize independent ON state of a partition of the area, which causes extra power loss of a GOA circuit and a data IC circuit. The GOA unit controls partitioning of the display area for display, which can significantly reduce the power loss of the GOA circuit and the data IC circuit.

The foregoing description is merely an overview of the technical solutions of the present disclosure. In order to understand the technical solutions of the present disclosure more clearly so that the technical solutions can be practiced according to the content of the specification and in order to make the above and other objects, features and advantages of the present disclosure more obvious and understandable, specific embodiments of the present disclosure are given below.

The algorithms and displays provided herein are not inherently relevant to any particular computer, virtual system, or other devices. Various general-purpose systems can also be used with the teaching based thereon. According to the above description, a structure required to construct such a system is obvious. In addition, the present disclosure is not directed to any particular programming language. It should be understood that the content of the present disclosure described here can be embodied in various programming languages and that the foregoing description of a particular language is intended to disclose the best implementation of the present disclosure.

A number of specific details are set forth in the specification provided here. It will be understood, however, that the embodiments of the present disclosure can be practiced without these specific details. In some instances, well-known methods, structures, and techniques have not been shown in detail so as not to obscure the understanding of this specification.

Similarly, it is to be understood that in the foregoing description of exemplary embodiments of the present disclosure, various features of the present disclosure are sometimes grouped together into a single embodiment, a figure, or a description thereof in order to simplify the present disclosure and to assist in understanding one or more of the various disclosed aspects. However, the method according to the present disclosure should not be construed as reflecting the intention that the claimed disclosure requires more features than those recited in each of the claims. Rather, as reflected in the following claims, the disclosed aspect has features less than all the features in a single embodiment disclosed above. Accordingly, the claims that follow the detailed description are expressly incorporated into this detailed description, wherein each claim per se is an individual embodiment of the present disclosure.

It will be appreciated by those skilled in the art that modules in a device in an embodiment can be adaptively changed and placed in one or more devices that are different from that in the embodiment. The modules or units or components in the embodiment can be combined into one module or unit or component, and in addition, they may be divided into a plurality of sub-modules or sub-units or sub-components. Except that at least some of such features and/or processes or units are mutually exclusive, all the features disclosed in this specification (including the appended claims, the abstract and the accompanying drawings) and all processes or units of any of the methods or devices disclosed herein can be combined in any way.

Unless otherwise expressly stated, each feature disclosed in this specification (including the appended claims, the abstract and the accompanying drawings) can be replaced by alternative features that provide the same, equivalent or similar purpose.

In addition, it will be understood by those skilled in the art that although some of the embodiments described herein comprise certain features included in other embodiments instead of other features, combinations of features of different embodiments are intended to be within the scope of the present disclosure and to form different embodiments. For example, in the following claims, any of the claimed embodiments can be used in any combination.

The various component embodiments of the present disclosure can be implemented in hardware, or implemented in software modules running on one or more processors, or in a combination thereof. It will be appreciated by those skilled in the art that a microprocessor or a Digital Signal Processor (DSP) may be used in practice to implement some or all the functions of some or all the components in the method and apparatus for driving GOA partitioning and the GOA unit device according to the embodiments of the present disclosure. The present disclosure can also be implemented as devices or apparatus programs (for example, computer programs and computer program products) configured to perform some or all the methods described herein. Such programs for implementing the present disclosure can be stored on a computer-readable medium, or may be in forms of one or more signals. Such signals may be downloaded from the Internet web site, which are either provided on a carrier signal or in any other form.

It should be noted that the embodiments described above illustrate the present disclosure and are not intended to limit the present disclosure, and those skilled in the art can devise alternative embodiments without departing from the scope of the appended claims. In the claims, any reference signs between parentheses should not be construed as limiting the claims. The word "comprises" does not exclude the presence of elements or steps not listed in the claims. The word "a" or "an" before an element does not exclude the presence of a plurality of such elements. The present disclosure can be implemented by means of hardware comprising several different elements and by means of a suitably programmed computer. In the unit claims enumerating several apparatuses, several of these apparatuses can be embodied by the same hardware item. The use of the words "first", "second", and "third" etc. does not indicate any order. These words can be interpreted as names.

We claim:

1. A partition-based gate driving method, comprising:

generating a control signal according to an acquired human eye observation partition;

generating a second clock signal or a third clock signal according to the control signal; and controlling a second output signal according to the second clock signal or controlling a third output signal according to the third clock signal, thereby controlling refresh rates of a corresponding human eye observation partition and a corresponding non-human eye observation partition in a display area, respectively, wherein the second clock signal has a frequency different from that of the third clock signal.

2. The method according to claim 1, wherein controlling a second output signal according to the second clock signal or controlling a third output signal according to the third clock signal thereby controlling refresh rates of a corresponding human eye observation partition and a corresponding non-human eye observation partition in a display area respectively comprises:

controlling partitions in the display area corresponding to the second output signal or the third output signal to be refreshed when the second output signal or the third output signal is output at a high level, and controlling partitions in the display area corresponding to the second output signal or the third output signal not to be refreshed when the second output signal or the third output signal is output at a low level.

3. A partition-based gate driving apparatus, comprising:

a control signal generation module configured to generate a control signal according to an acquired human eye observation partition;

a clock signal generation module configured to generate a second clock signal or a third clock signal according to the control signal; and a partition display control module configured to control a second output signal according to the second clock signal or control a third output signal according to the third clock signal, thereby controlling refresh rates of a corresponding human eye observation partition and a corresponding non-human eye observation partition in a display area, respectively.

4. The apparatus according to claim 3, wherein the partition display control module comprises:

a display area control module configured to control partitions in the display area corresponding to the second output signal or the third output signal to be refreshed when the second output signal or the third output signal is output at a high level, and configured to control partitions in the display area corresponding to the second output signal or the third output signal not to be refreshed when the second output signal or the third output signal is output at a low level.

5. A gate driving unit, comprising:

a shift unit configured to control a first output signal thereof under the control of a shift pulse input from a first input signal terminal; and a partition unit configured to receive the first output signal from the shift unit as a second input signal of the partition unit, and the partition unit further configured to control a second output signal of the partition unit under the control of a second clock signal or control a third output signal of the partition unit under the control of a third clock signal, thereby controlling refresh rates of a corresponding human eye observation partition and a corresponding non-human eye observation partition in a display area, respectively.

6. The gate driving unit according to claim 5, wherein the partition unit comprises a second input module, a second pull-up node reset module, a second reset module, a second output module, a third output module, a second de-noising module, and a third de-noising module, wherein the second input module is connected to a first output signal terminal of the shift unit and a second pull-up node, respectively, and is configured to pull up a potential at the second pull-up node under the control of a first output signal from the first output signal terminal;

wherein the second pull-up node reset module is connected to the second pull-up node and a second pull-down signal terminal, respectively, and is configured to control the potential at the second pull-up node under the control of a second pull-down signal provided by the second pull-down signal terminal;

wherein the second reset module is connected to a second reset signal terminal and the second pull-up node, respectively, and is configured to reset the potential at the second pull-up node under the control of a second reset signal provided by the second reset signal terminal;

wherein the second output module is connected to the second pull-up node, a second clock signal terminal, and a second output signal terminal, respectively, and is configured to control a second output signal at the second output signal terminal under the control of the second pull-up node and a second clock signal;

wherein the third output module is connected to the second pull-up node, a third clock signal terminal, and a third output signal terminal, respectively, and is configured to control a third output signal at the third output signal terminal under the control of the second pull-up node and a third clock signal;

wherein the second de-noising module is connected to the second output signal terminal and the second pull-down signal terminal, respectively, and is configured to de-noise the second output signal at the second output signal terminal under the control of the second pull-down signal provided by the second pull-down signal terminal; and wherein the third de-noising module is connected to the third output signal terminal and the second pull-down signal terminal, respectively, and is configured to de-noise the third output signal at the third output signal terminal under the control of the second pull-down signal provided by the second pull-down signal terminal.

7. The gate driving unit according to claim 6, wherein the second input module comprises a ninth transistor having a control terminal connected to the first output signal terminal, an input terminal connected to a power supply terminal, and an output terminal connected to the second pull-up node.

8. The gate driving unit according to claim 6, wherein the second pull-up node reset module comprises an eleventh transistor having a control terminal connected to the second pull-down signal terminal, an input terminal connected to the second pull-up node, and an output terminal connected to a low level terminal.

9. The gate driving unit according to claim 6, wherein the second reset module comprises a tenth transistor having a control terminal connected to the second reset signal terminal, an input terminal connected to the second pull-up node, and an output terminal connected to a low level terminal.

10. The gate driving unit according to claim 6, wherein the second output module comprises a fifth transistor having a control terminal connected to the second pull-up node, an input terminal connected to the second clock signal terminal, and an output terminal connected to the second output signal terminal.

11. The gate driving unit according to claim 6, wherein the third output module comprises a seventh transistor having a control terminal connected to the second pull-up node, an input terminal connected to the third clock signal terminal, and an output terminal connected to the third output signal terminal.

12. The gate driving unit according to claim 6, wherein the second de-noising module comprises a sixth transistor having a control terminal connected to the second pull-down signal terminal, an input terminal connected to the second output signal terminal, and an output terminal connected to a low level terminal.

13. The gate driving unit according to claim 6, wherein the third de-noising module comprises an eighth transistor having a control terminal connected to the second pull-down signal terminal, an input terminal connected to the third output signal terminal, and an output terminal connected to a low level terminal.

14. A gate driving circuit comprising a plurality of cascaded gate driving units according to claim 5, wherein a first input signal terminal of a first stage of gate driving unit is connected to an initial signal input terminal;

wherein a first output signal terminal of an $N^{th}$ stage of gate driving unit is connected to a first reset signal terminal of an $(N-1)^{th}$ stage of gate driving unit, where N is an integer greater than or equal to 3;

wherein the first output signal terminal of the $N^{th}$ stage of gate driving unit is connected to a second reset signal terminal of an $(N-2)^{th}$ stage of gate driving unit;

wherein the first output signal terminal of the $N^{th}$ stage of gate driving unit is connected to a first input signal terminal of an $(N+1)^{th}$ stage of gate driving unit; and wherein a first pull-down signal terminal of the $N^{th}$ stage of gate driving unit is connected to a second pull-down signal terminal of the $(N-1)^{th}$ stage of gate driving unit.

15. A display apparatus comprising a gate driving circuit according to claim 14.

* * * * *